United States Patent [19]

Mezger et al.

[11] Patent Number: 4,842,659

[45] Date of Patent: Jun. 27, 1989

[54] INSENSITIVE HIGH ENERGY EXPLOSIVE COMPOSITIONS

[75] Inventors: Mark Mezger, Hackettstown; Bernard Strauss, Rockaway; Sam M. Moy, Parsippany; Joseph L. Prezelski, Budd Lake, all of N.J.

[73] Assignee: The United States of America as represented by the Secretary of the Army, Washington, D.C.

[21] Appl. No.: 184,930

[22] Filed: Apr. 22, 1988

[51] Int. Cl.[4] ..... C06B 45/10

[52] U.S. Cl. ..... 149/19.2; 149/88; 149/92; 149/19.7

[58] Field of Search ..... 149/88, 92, 19.7, 19.2

[56] References Cited

U.S. PATENT DOCUMENTS

| | | | |
|---|---|---|---|
| H350 | 10/1987 | Adolph et al. | 149/88 |
| 4,097,316 | 6/1978 | Mullay | 149/92 |
| 4,389,263 | 6/1983 | Allen | 149/88 |

*Primary Examiner*—Stephen J. Lechert, Jr.

*Attorney, Agent, or Firm*—Robert P. Gibson; Edward Goldberg; Edward F. Costigan

[57] ABSTRACT

A high energy explosive composition containing 80 to 95 percent HMX having a low susceptibility to sympathetic detonation. The composition also contains between 2.9 to 10 percent cellulose acetate butyrate, 10 to 17.1 percent of 1:1 mixture of bis 2,2-dinitropropyl acetate and bis 2,2-dinitropropyl formal, and 0.5 percent tri (dioctyl phosphato) titanate.

10 Claims, 3 Drawing Sheets

SYMPATHETIC DETONATION TEST
FOR
THE 25mm HE MUNITION

SYMPATHETIC DETONATION TEST
FOR
THE 25mm HE MUNITION

INSENSITIVE HIGH ENERGY EXPLOSIVE COMPOSITIONS

GOVERNMENTAL INTEREST

The invention described herein may be manufactured used and licensed by or for the Government for Governmental purposes without payment to us of any royalties thereon.

FIELD OF USE

This invention relates to high energy explosive compositions having effective and efficient performance characteristics which demonstrate a low susceptibility to sympathetic detonation while maintaining a high energy output

BACKGROUND OF INVENTION

Insensitive Munitions must be developed to improve the combat survivability of an armament vehicle. It has been found that munitions utilized in some weapon systems are vulnerable to sympathetic detonation. For instance, the cannon caliber ammunition stored aboard these vehicles is vulnerable to initiation via shape charge jet and then propagation of the reaction due to sympathetic detonation.

This sympathetic detonation and propagation scenario can be summarized as follows: if a round is hit by a shape charge jet, it is initiated. As a result, the fragments that are generated by the blast then strike the other rounds that are adjacent to it. The latter rounds then initiate, contributing to the overall reaction and damage sustained by the vehicle, crew, and other munitions. The mechanisms of reaction for the initiation of the surrounding rounds are due to the blast and fragments impinging on the aforesaid adjacent round. The probability of sympathetic detonation can be reduced in several ways. This can be done by reconfiguring the ammunition compartments within the vehicle. It can also be accomplished by packaging the ammunition with anti-fraticide materials. However, each of the aforesaid solutions will reduce the amount of space available for the storage of ammunition. The most acceptable solution to the problem is to reduce the sensitivity of the energetic material to sympathetic detonation Incorporating less sensitive energetic material will reduce the vulnerability of initiation from the cited threats without reducing the number of rounds stored in the vehicle. It has been found that by reducing the vulnerability to sympathetic detonation of the energetic materials used in these munitions, the probability of catastrophic reaction can be minimized.

However, the development of explosive compositions for military applications is also motivated by the need for insensitive explosives with high energy output. This problem has always plagued the military, but in recent years it has become more critical. Increased performance requirements on munitions are making it necessary to utilize higher energy explosives. Consequently, explosives tend to become more sensitive and vulnerable to sympathetic detonation as the energy content of the formulation increases.

Explosive compositions have traditionally been developed along three basic avenues. The first of which takes an energetic filler such as cyclotrimethylene trinitramine cyclotetramethylene tetranitramine, pentaerythritol tetranitrate, etc, . . . , and combines it with an energetic binder such as trinitrotoluene or nitrocellulose. These compositions exhibit high energy output with lower concentrations of energetic filler but they tend to be too sensitive for new military applications. The second approach is to combine a high percentage of explosive filler in an inert binder usually an organic wax or polymer. By varying the percentage of explosive filler, the sensitivity and energy output of the material can be changed. Typically, one can improve the vulnerability of the composition by lowering the concentration of filler but this will also lower the energy output. The objective then becomes finding the concentration of binder that lowers the sensitivity to an acceptable level while maintaining as high an energy output as possible. The third approach is to synthesize new energetic molecules.

The explosive formulations developed to date using the techniques described above have not yielded high energy output explosives that demonstrate a low enough susceptibility to sympathetic detonation to be considered for use in insensitive munitions. Previous efforts have failed in this respect in that they did not discover the proper combination filler or binder (i.e. in either chemical type or concentration level) to yield these properties.

The result of this invention is a high energy output explosive which is comparable to PBXN-5 having a composition of 95% HMX and 5% of an inert binder. The latter composition is the conventional explosive utilized in cannon caliber ammunition. The advantage of this invention over PBXN-5 is that the new explosive composite demonstrates a sharp reduction in the vulnerability to sympathetic detonation.

SUMMARY OF INVENTION

It is an object of this invention to relatively reduce the incident of catastrophic damage to vehicle, crew and munitions from sympathetic detonation involving munitions aboard an armament vehicle.

Another object is to provide insensitive explosive compositions which relatively reduce sympathetic detonation involving munitions.

A further object is to provide explosive compositions which tend to be less sensitive to impact initiation.

An still another object is to provide insensitive energetic materials as replacement for the conventional explosives in cannon caliber ammunition.

These and other objects will be more apparent from a reading of the following detailed description when taken will the accompanying drawings wherein.

Figure 1:
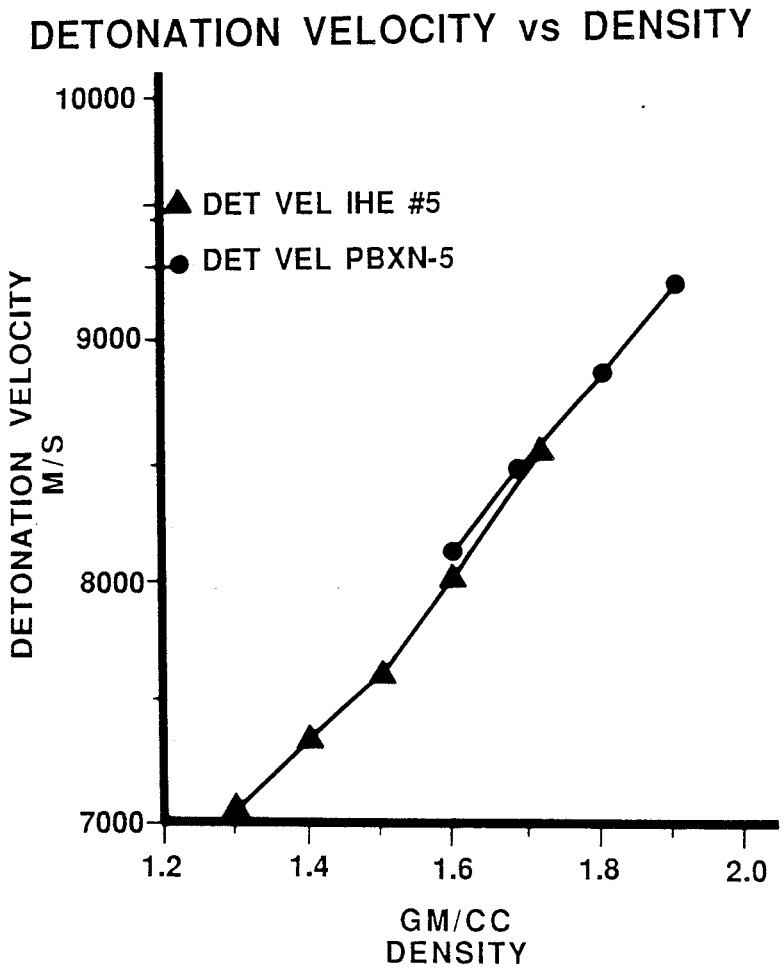
FIG. 1 is a graph representing the detonation velocity of the conventional explosive of the art and a composition included in this invention.

Impact sensitivity of reactive materials indicates that softer explosives tend to be less sensitive to impact initiation than hard explosives. The sensitivity of explosives are therefor dependent on the mechanical properties of the material. Thus, by changing the matrix of a material, the mechanical properties are altered. To therefor desensitize an explosive in a composite, a soft matrix should be used to accomplish this purpose. The compressive strength of the matrix can be changed by varying the plasticizer to binder ratio of the composition. For example, by increasing the plasticizer in the composition, the strength at high strain can be decreased. In this manner, a spectrum of properties of the matrix material of a composition can be achieved without changing the chemical constituents.

It has been found that if the matrix material and filler content of an explosive composition are varied, the sensitivity of the composition can be reduced while maintaining the energy output of the composition.

In this invention, eight explosive compositions were processed using a solvent evaporation process. The compositions are listed in Table 1.

| CHEMICAL COMPOUND | 1 | 2 | 3 | 4 | 5 | 6 | 7 | 8 |
|---|---|---|---|---|---|---|---|---|
| HMX | 80 | 85 | 90 | 95 | 80 | 85 | 90 | 95 |
| CAB | 11.5 | 8.5 | 5.5 | 2.7 | 7.5 | 5.5 | 3.5 | 1.5 |
| BDNPA/F | 8 | 6 | 4 | 2 | 12 | 9 | 6 | 3 |
| COUPLING AGENT | 0.5 | 0.5 | 0.5 | 0.5 | 0.5 | 0.5 | 0.5 | 0.5 |

1. CAB is Cellulose Acetate Butyrate
2. BDNPA/F is a 1:1 mixture of BIS 2,2-Dinitropropyl acetate and BIS 2,2-Dinitropropyl formal.
3. Coupling agent is LICA 12 i.e. TRI (Dioctyl Phosphato) titanate.

Two families of explosive materials were formulated, each with a binder to plasticizer ratio of 1.5 to 1 and 1 to 1.5. These ratios correspond to a hard and soft matrix material respectively. For each explosive composition, the nitramine filler content was varied in 5% increments from 80 to 95 percent.

Differential Thermal analysis was conducted on each of the above formulation, and the results were tabulated in Tables 2 and 3.

TABLE 2

| IHE # | ENDOTHERM ONSET C.° | ENDOTHERM PEAK | EXOTHERM ONSET C.° | EXOTHERM PEAK |
|---|---|---|---|---|
| 1 | 187 | 192 | 276 | 279 |
| 2 | 189 | 194 | 276 | 280 |
| 3 | 190 | 195 | 276 | 280 |
| 4 | — | — | — | — |

TABLE 3

| IHE # | ENDOTHERM ONSET C.° | ENDOTHERM PEAK | EXOTHERM ONSET C.° | EXOTHERM PEAK |
|---|---|---|---|---|
| 5 | 197 | 200 | 280 | 283 |
| 6 | 191 | 196 | 281 | 284 |
| 7 | 198 | 203 | 280 | 283 |
| 8 | — | — | — | — |

These measurements show an endotherm in the vicinity of 190° C. due to a phase change in the explosive filler and an extrapolated onset at approximately 280° C. This is the same endotherm and exotherm achieved with PBXN-5 which is the conventional explosive composition utilized in the cannon caliber ammunition of the art.

The results of the impact sensitivity and shock sensitivity are presented in Table 4 and 5. It is to be noted that the sensitivity of HMX is decreased by increasing the plasticizer to binder ratio. The impact and shock sensitivity of PBXN-5, the conventional composition, was measured to be 21.2 cm and 5064 volts respectively. Increasing the amount of plasticizer in the composition of this invention tends to separate the polymer chains in the glassy state. This produces a relatively softer matrix which will absorb impact energy that may otherwise contribute to initiating the composition. As the results indicate, the softer matrix yields a material that is less sensitive to impact, shock, and sympathetic detonation.

TABLE 4

IMPACT AND SHOCK SENSITIVITY

| FORMULATIONS # | IMPACT SENSITIVITY CM | SHOCK SENSITIVITY VOLTS |
|---|---|---|
| 5 | 44.7 | 6700 |
| 6 | 43.2 | 5400 |
| 7 | 34.5 | 4783 |
| 8 | 22.8 | — |

TABLE 5

| FORMULATION # | IMPACT SENSITIVITY CM | SHOCK SENSITIVITY VOLTS |
|---|---|---|
| 5 | 46.2 | 7250 |
| 6 | 39.3 | 5350 |
| 7 | 37.2 | 4900 |
| 8 | 23.6 | — |

There appears to be a change of only a few cm in the impact sensitivity for a given concentration of explosive filler as the plasticizer to binder ratio is increased. A more dramatic effect in impact sensitivity is seen for a particular binder composition as the concentration of explosive filler increases. For both matrix materials, the 80% filled compositions gave impact sensitivities in the mid forties (cm) and for the 95% filled materials it was in the low twenties. As may be seen from the data in Tables 4 and 5, the sensitivity of the composition of this invention are dramatically improved when compared to that of PBXN-5, the conventional explosive of the art.

Changes in plasticizer concentration have a more pronounced effect on the shock sensitivity. The materials with the lowest concentration of nitramine gave shock sensitivities of 6700 and 7250 volts for the low and high ratios of plasticizer to binder respectively. In this test the voltage corresponds to a flyer plate velocity which in turn corresponds to a shock pressure. The larger the voltage, the larger the shock pressure. For each matrix material the composite explosives become more sensitive as the filler concentration increases. Differences in the shock sensitivity between the hard and soft matrix materials is most apparent at the 80% filler level. Formulation number 5 (i.e. IHE #5) was selected for detonation velocity and sympathetic detonation tests.

The detonation pressure and velocity of formulation number 5 of Table one are plotted as a function of density and compared to PBXN-5 Formulation #5 which contains (80% explosive filler, 12% plasticizer, 8% binder is the least energetic of the compositions that have been processed. As can be seen in the FIGS. 2 and 3, detonation pressure and velocity of this composition are comparable to PBXN-5 in the range of densities from approximately 1.6 to 1.75 g/cc.

Figure 2:
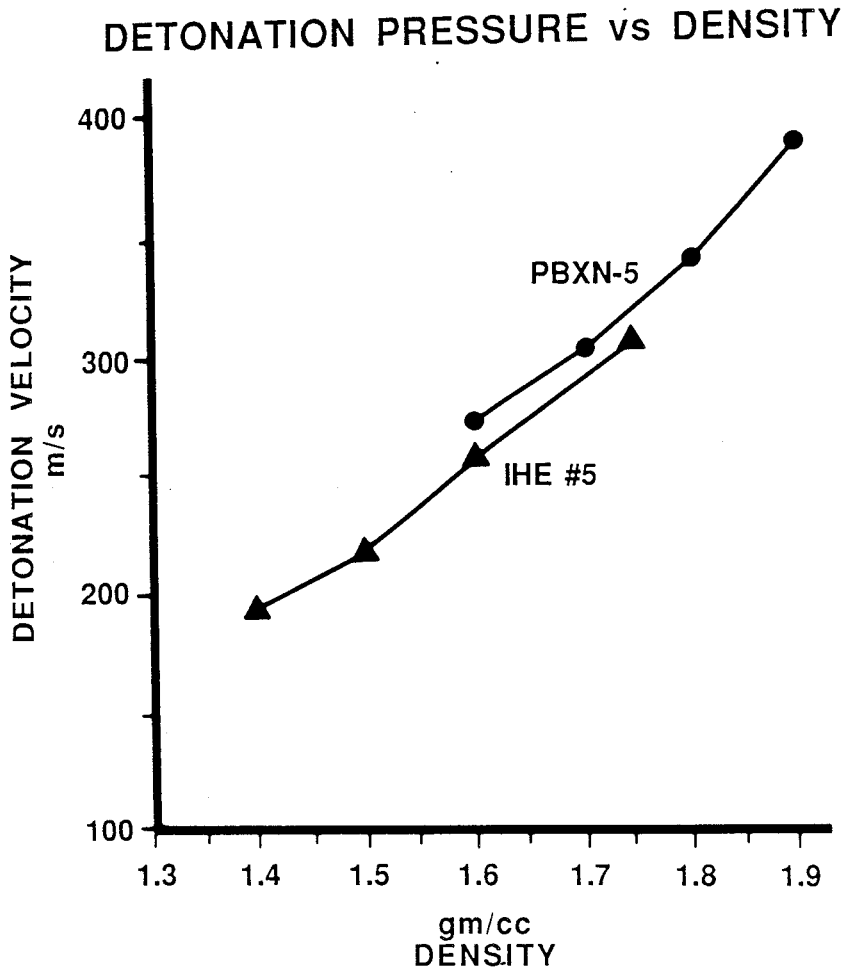
FIG. 2 is a graph representing the detonation pressure of the conventional explosive of the art and a composition of this invention.

The calculated detonation velocities and pressures of the IHE #5 and the PBXN-5 are set forth in the graphs of FIGS. 1 and 2. The graphs show that in the usable range of densities, the energy of composition IHE #5 of this invention is nearly equal to the PBXN-5, the latter being the conventional explosive for cannon caliber ammunition.

Figure 3:
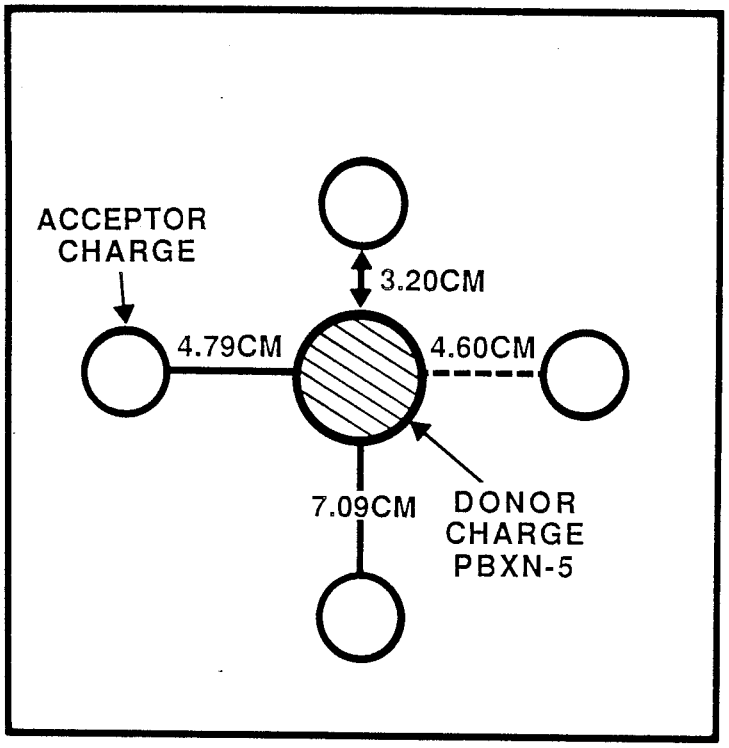
FIG. 3 is a view of a witness plate showing the distances of the sympathetic initiation of the munitions of the art and that of a composition of the this invention.

The test configuration for the sympathetic detonation test is shown in FIG. 3. The test is based on the storage of ammunition in a light armored vehicle. The spacings between the centers of these cylinders corresponds to the four nearest neighboring rounds that any other rounds would have as it is stored in an ammunition box. Test results of the PBXN-5 resulted in four out of four acceptor tubes going high order. This demonstrates the sensitivity of that explosive to sympathetic detonation. The IHE #5 composition of this invention results in only one acceptor cases detonating high order, i.e. the acceptor tube nearest in distance. This represents a significant state-of-the-art improvement in the formulation and manufacture of new high energy insensitive explosive systems that can be readily used for Insensitive Munitions.

The explosive composition (IHE #5) of this invention was compared with several explosive composition which are in use today. The results are set forth in the table which follows.

| EXPLOSIVE | IMPACT SENSITIVITY (CM) | DETONATION GURNEY VELOCITY (M/S) | M830 PREDICTED ENERGY M/S | M830 PREDICTED JET VELOCITIES (M/S) |
|---|---|---|---|---|
| COMP A-3, TYPE II | 43 | 8175 | 2563 | 7700 |
| R8151 | 29 | 8212 | — | 8000 |
| COMP. B | 36 | 7880 | 2538 | — |
| IHE #5 | 58 | 1.82 | 2880 | 8800 |

As the results indicate, IHE #5 is an improvement in many respects than the compositions of the art.

The composition of this invention was then varied to contain 80% HMX, 10% cellulose acetate butyrate, and 10% of the cited 2;2 - dinitropropyl type binder. It was then compared to LX-14, which is a conventional explosive, containing 95.5% HMX and estane. The results are set forth below.

| | IMPACT SENSITIVITY (cm) | SHOCK SENSITIVITY (volts) | THEO. MAX. DENSITY gm/cc | DETONATION VELOCITY M/S | PRESSURE KATM |
|---|---|---|---|---|---|
| IHE | 51 | 9100 | 1.744 | 8545 | 305 |
| LX-14 | 23-26 | 4700 | 1.849 | 9100 | 365 |

As the results indicate, the IHE composition of this invention is dramatically less sensitive than that of the art. However the energy output of IHE is quite high and acceptable in the field when compared to the conventional explosive.

MANUFACTURING PROCESS

In the proportions set forth in Table 1, the ingredients are processed in the following manner. For example, Class 5 HMX is added to a solution of LICA 12 and acetate with ethyl alcohol to provide a mixing fluidity. The resulting mass is then mixed in a horizontal sigma blade mixer for 15 minutes. After thorough mixing, the resulting mix is heated to 105° F. At this point, CAB is added to the mass, and mixing is continued for an addition 10 minutes. BDNPAF is then added to the mass, and mixing is continued for 10 minutes. The cited solvents are again added in an amount fo provide a mixing fluidity, and the resultant mass is mixed for another 30 minutes at 105° F. The system is blowndown with CO2 at 12 PSIG, and then cooled down to room temperature.

The course materials produced above are reduced to fines, and screened through a standard 20 mesh screen. The resulting granulated mass is air dried for 1 day, and tehn over dried until total volatiles are below 1%.

USE

The explosives of this invention are specifically designed for use as an relatively insensitize replacement for PBXN-5. However, any munition that will utilize PBXN-5 or LX-14 may be made less sensitive by incorporating the compositions of this invention. The specific use could now be in the 25MM HEIT M792 munition. The composition of this invention is loaded into the aforesaid shall in the manner conventionally known in the art of explosives.

The foregoing disclosure and drawings are merely illustrative of the principles of this invention and are not to be interpreted in a limiting sense. We wish it to be understood that we do not desire to be limited to the exact details of construction shown and described because obvious modifications will occur to a person skilled in the art.

What is claimed is:

1. In an improved high energy explosive composition containing about 80 to 95 percent cyclotetramethylene tetranitramine being relatively insensitive to sympathetic detonation, the improvement consisting essentially of the incorporation of between about 2.9 to 10 percent cellulose acetate butyrate and about 10 to 17.1 percent of 1:1 mixture of bis 2,2 - dinitropropyl acetate and bis 2,2 - dinitropropyl formal, and about 0.5 percent tri (dioctyl phosphato) titanate, all said percents being by weight based on the total weight of said composition.

2. The composition of claim 1 wherein said components are present in percent by weight, viz about 80 percent cyclotetramethylene tetranitramine
about 10 percent cellulose acetate butyrate,
about 10 percent 1:1 mixture of bis 2,2 - dinitropropyl acetate and bis 2,2 - dinitropropyl formal, and
about 0.5 percent tri (dioctyl phosphato) titanate.

3. The composition of claim 1 wherein said components are present in percent by weight, viz about 80 percent cyclotetramethylene tetranitramine,
about 11.5 percent cellulose acetate butyrate,
about 8 percent of 1:1 mixture of bis 2,2 - dinitropropyl acetate and bis 2,2 - dinitropropyl formal, and
about 0.5 percent tri (dioctyl phosphato) titanate.

4. The composition of claim 1 wherein said components are present in percent by weight, viz about 85 percent cyclotetramethylene tetranitramine
about 8.5 percent cellulose acetate butyrate,
about 6 percent of 1:1 mixture of bis 2,2 - dinitropropyl acetate and bis 2,2 - dinitropropyl formal, and
about 0.5 percent tri (dioctyl phosphato) titanate.

5. The composition of claim 1 wherein said components are present in percent by weight, viz
about 90 percent cyclotetramethylene tetranitramine,
about 5.5 percent cellulose acetate butyrate,
about 4 percent of 1:1 mixture of bis 2,2 - dinitropropyl acetate and bis 2,2 - dinitropropyl formal, and
about 0.5 percent tri (dioctyl phosphato) titanate.

6. The composition of claim 1 wherein said components are present in percent by weight, viz
about 95 percent cyclotetramethylene tetranitramine,
about 2.5 percent cellulose acetate butyrate,
about 2 percent of 1:1 mixture of bis 2,2 - dinitropropyl acetate and bis 2,2 - dinitropropyl formal, and
about 0.5 percent tri (dioctyl phosphato) titanate.

7. The composition of claim 1 wherein said components are present in percent by weight, viz
about 80 percent cyclotetramethylene tetranitramine
about 7.5 percent cellulose acetate butyrate,
about 12 percent of 1:1 mixture of bis 2,2 - dinitropropyl acetate and bis 2,2 - dinitropropyl formal, and
about 0.5 percent tri (dioctyl phosphato) titanate.

8. The composition of claim 1 wherein said components are present in percent by weight, viz
about 85 percent cyclotetramethylene tetranitramine,
about 5.5 percent cellulose acetate butyrate,
about 9 percent of 1:1 mixture of bis 2,2 - dinitropropyl acetate and bis 2,2 - dinitropropyl formal, and
about 0.5 percent tri (dioctyl phosphato) titanate,

9. The composition of claim 1 wherein said components are present in percent by weight, viz
about 90 percent cyclotetramethylene tetranitramine,
about 3.5 percent cellulose acetate butyrate,
about 6 percent of 1:1 mixture of bis 2,2 - dinitropropyl acetate and bis 2,2 - dinitropropyl formal, and
about 0.5 percent tri (dioctyl phosphato) titanate.

10. The composition of claim 1 wherein said components are present in percent by weight, viz
about 95 percent cyclotetramethylene tetranitramine,
about 1.5 percent cellulose acetate butyrate,
about 3 percent of 1:1 mixture of bis 2,2 - dinitropropyl acetate and bis 2,2 - dinitropropyl formal, and
about 0.5 percent tri (dioctyl phosphato) titanate.

* * * * *